United States Patent [19]

Notelteirs et al.

[11] 4,414,484

[45] Nov. 8, 1983

[54] ELECTRIC INCANDESCENT LAMP

[75] Inventors: Victor R. Notelteirs; Stephanus J. Claessens, both of Eindhoven, Netherlands

[73] Assignee: U.S. Philips Corporation, New York, N.Y.

[21] Appl. No.: 272,437

[22] Filed: Jun. 10, 1981

[30] Foreign Application Priority Data

Jul. 14, 1980 [NL] Netherlands ..... 8004030

[51] Int. Cl.[3] ..... H01J 1/88; H01J 19/42; H01K 1/18

[52] U.S. Cl. ..... 313/273; 313/274; 313/315

[58] Field of Search ..... 313/272, 273, 274, 315

[56] References Cited

U.S. PATENT DOCUMENTS

| | | | |
|---|---|---|---|
| 3,416,024 | 12/1968 | Young | 313/273 |
| 3,764,845 | 10/1973 | De Fraeye | 313/273 |
| 4,272,698 | 6/1981 | Oyama et al. | 313/274 |

*Primary Examiner*—Saxfield Chatmon
*Attorney, Agent, or Firm*—Robert S. Smith

[57] ABSTRACT

In an electric incandescent lamp having a tungsten filament with a number of light-emissive sections (5, 7) connected by a non-light-emissive conductor, complicated constructions are often used so that said non-light-emissive conductor dissipates little energy.

In such an incandescent lamp according to the invention the non-light-emissive conductor consists of a piece (9) of the tungsten wire (1) from which the light-emissive sections (5, 7) have been wound helically and around which a wire (2) of a less noble metal than tungsten is wound.

The lamp may be used as a copying lamp. FIG. 1*e*.

1 Claim, 7 Drawing Figures

ELECTRIC INCANDESCENT LAMP

Figure 1A:
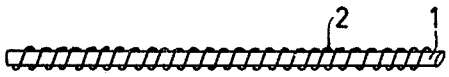

The invention relates to an electric incandescent lamp having a light-transmissive tubular lamp envelope which at its ends is sealed in a vacuum-tight manner around a respective conduct which supplies current to a filament stretched longitudinally in the lamp envelope between the ends. The filament has a plurality of light-emissive sections of helically wound tungsten wire, adjacent light-emissive sections being connected to each other by a respective piece of the tungsten wire from which said sections are wound. The piece of tungsten wire extends substantially in the longitudinal direction of the lamp envelope.

Such an electric lamp is disclosed in U.S. Pat. No. 3,295,007 and may be used as a copying lamp for exposing an original and for drying and/or fixing the print.

In order to be able to expose paper uniformly with such a lamp, the light-emissive sections are longer near the ends of the lamp or are closer together than more towards the center.

In copying lamps there exists a trend towards longer lamp so as to be able to expose paper of a larger format, and towards lower power per centimeter of length, for example less than 20 W/cm of lamp length. This involves that the length of non-light-emissive parts of the filament, notably near the center of a lamp, becomes still larger. In these lamps also, however, the distance between adjacent light-emissive sections situated near the ends of the lamp are small, for example, approximately 1 cm.

In the known copying lamp the light-emissive sections of the filament and the conductors which connect each two adjacent sections are formed from one piece of tungsten wire. Although the current density in the conductors which connect two adjacent light-emissive sections is equally large as that in the light-emissive sections, said conductors nevertheless emit no or substantially no light. This is caused by the fact that per unit of wire length these parts lose more thermal energy to and receive less radiation from their ambient than the turns of the light-emissive sections and thus are at a lower temperature.

According as the conductors between two adjacent light-emissive sections become longer and the power of the lamp becomes lower, the efficiency of the lamp decreases as a result of the increasing quantity of energy which is dissipated in these conductors. An additional disadvantage of the known lamp is that, according as the conductors totally become longer in relation to the overall length of the light-emissive sections, the thermal expansion of the conductors starts exerting an ever increasing influence on the light-emissive sections and will deform then and short-circuit the turns thereof.

In order to mitigate these disadvantages, a variety of constructions have been suggested which come down to the fact that the conductors between adjacent light-emissive sections consist of much thicker wire than the light-emissive sections and that said conductors are screwed in or around the light-emissive sections. Examples of such constructions are those described in U.S. Pat. Nos. 3,943,395 and 4,185,219. However, the disadvantage of such constructions is that the filament has to be built up manually from a large number of components, which causes too high a cost-price. In many cases the constructions are heavy and hence sensitive to shock and vibration.

In other constructions, non-light-emissive parts are obtained by short-circuiting a number of turns wound with constant pitch, for example, by means of a rod within those turns, as described in German Auslegeschrift No. 1,797,441, or by providing a second layer of turns about it, as described in British patent specification No. 1,360,347. These constructions are also comparatively heavy and involve a large amount of metal.

It is the object of the invention to provide a copying lamp having a filament of a simple, stable construction with a small amount of metal.

According to the invention, this object is achieved in an electric lamp of the kind described in the opening paragraph in that wire of a less noble metal than tungsten is wound around the piece of tungsten wire between adjacent light-emissive sections.

Since wire is wound around the piece of tungsten wire between two adjacent light-emissive sections, the electric resistance of the conductor between these light-emissive sections is reduced and hence the power absorbed by the conductor and the thermal energy evolved in the conductor is also reduced. The resistance of the conductor is smaller as the surrounding wire is thicker. Experience has taught, however, that in general an enveloping wire cannot be much thicker than a wire enveloped thereby, this being dependent on the rigidity of the enveloping wire. The resistance of the conductor is furthermore lower according as the pitch of the winding is smaller.

The lamp according to the invention is preferably filled with an inert gas which comprises halogen, for example in the form of hydrobromide, so as to reach a higher luminous efficiency which is substantially constant throughout its life. However, the lamp may be filled with inert gas only.

In the latter case there is a wider choice possibility for the material of which the enveloping wire exists. A metal is chosen which withstands the temperature occurring during operation of the lamp and which is chemically less noble than tungsten in order that, during the manufacture of the filament, it can be removed from places where it is not desired without attacking the filament. This will be explained hereinafter. Examples are: iron, steel, molybdenum. If the lamp also contains a halogen, attack of the enveloping wire by the halogen. should be prevented Also to be prevented is binding of the halogen to the wire and withdrawal of the halogen from the gas filling. In that case, for example, wire consisting at least substantially of molybdenum is used.

Figure 1B:
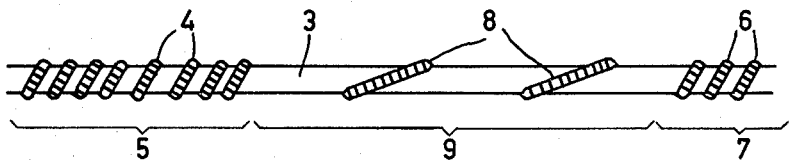
Figure 1C:
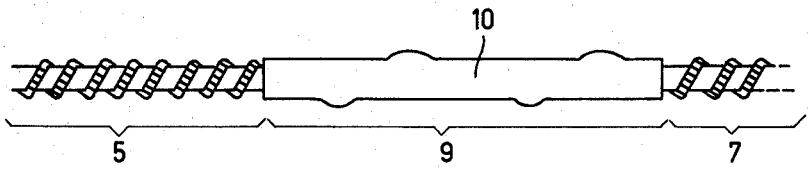
Figure 1D:
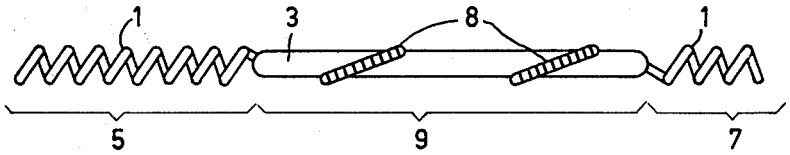
Figure 1E:
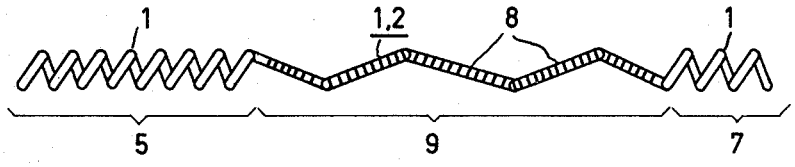
Figure 2:
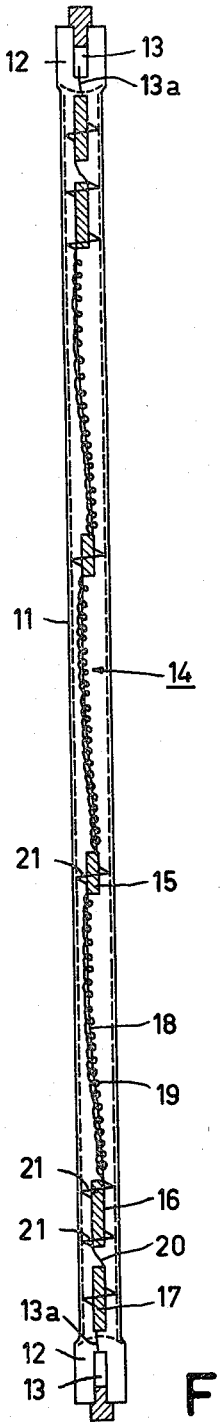
Figure 3:
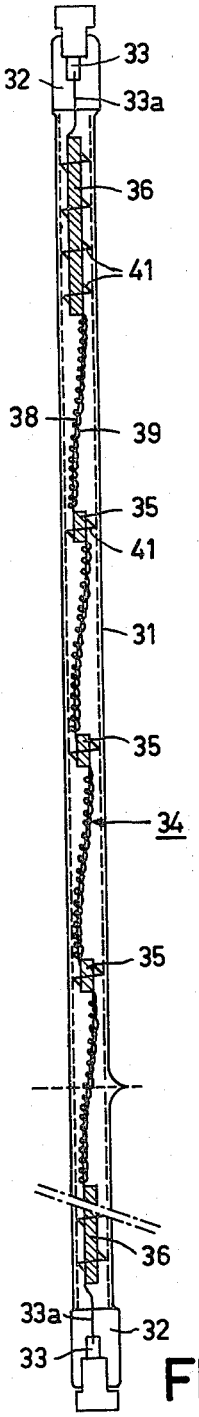

A filament suitable for use in a lamp according to the invention can easily be manufactured in a mechanized production process. This process, as well as embodiments of a lamp according to the invention, are shown in the drawing. In the drawing:

FIGS. 1*a* to 1*e* show diagrammatically stages of the production process of a filament, FIG. 2 shows diagrammatically a first embodiment of a lamp; and FIG. 3 shows diagrammatically a second embodiment of a lamp.

In FIG. 1*a*, a wire 2 is wound around a tungsten filament wire 1. The wire 2 is of a less noble metal than tungsten and may, for example, be of steel, iron or molybdenum.

In FIG. 1*b* the wound wire 1, 2 of FIG. 1*a* is wound according to a previously determined pattern on a mandrel 3 of, for example, steel, iron or molybdenum. First a plurality of turns 4 having a small pitch are wound, which turns subsequently form a light-emissive section 5. Before winding similar turns 6 for a light-emissive section 7, the wound wire 1, 2 is wound on the mandrel 3 with a much larger pitch to form turns 8 at the area where a non-light-emissive conductor 9 which connects the light-emissive sections 5 and 7, is to be formed.

The wound wire 1, 2 at the area of the turns 8 extends substantially in the longitudinal direction of the filament to be. The maximum value of the pitch of the turns 8 is determined by the largest acceleration and retardation which the winding machine used can give to the winding mandrel 3. With a view to minimizing both the consumption of material and the electrical resistance, the largest possible pitch will be chosen.

FIG. 1*c* shows the product of FIG. 1*b* after it has been annealed to remove winding stresses, and has then been coated at the area of the non-light-emissive conductor 9 with a substance 10 which protects the underlying metal against the subsequent action of an etching bath. The substance 10 may, for example, be shellac, phenolformaldehyde resin, or coumaron resin (polybenzofuran).

The product of FIG. 1*c* is then subjected to the action of an etching bath comprising, for example, 36.8% by weight of concentrated sulphuric acid, 30.8% by weight of concentrated nitric acid and 32.4% by weight of water. Since the winding wire 1 is of a less noble metal than the tungsten filament, the portions of wire 1 which are not protected by substance 10 are selectively etched away.

After washing away the protective layer 10 with, for example, trichloroethene, and rinsing the filament to be with deionized water, the product shown in FIG. 1*d* is obtained.

The light-emissive sections 5 and 7 in FIG. 1*d* comprise turns of the tungsten wire 1, while at the area of the non-light emissive conductor 9 to be the winding mandrel 3 in the turns 8 and the wire 2 around the turns 8 of the tungsten wire 1 have been maintained.

FIG. 1*e* shows the product of FIG. 1*d* after the remainder of the winding mandrel 3 has been removed therefrom. This can easily be done since the turns 8 of the wound wire 1, 2 have a very large pitch.

After a wire having a diameter which is 50 μm smaller than that of the winding mandrel 3 has been inserted in the product of FIG. 1*e*, it is provided with supporting members after which the wire is removed. The filament is then ready for assembly in the lamp envelope. The filament has adjacent light-emissive sections 5 and 7 of helically wound tungsten wire 1 which are connected by a piece 9 of the tungsten wire 1 which extends substantially in the longitudinal direction of the filament 5, 9, 7 and from which wire said sections 5 and 7 are wound, enveloped by wire 2.

Instead of, for example, molybdenum or iron, tungsten may be used as a material for the mandrel 3. When the winding wire 2 in the light-emissive sections 5, 7 has been removed by etching, the winding mandrel 3 becomes detached in the turns of said light-emissive sections 5, 7. As a result of the large pitch of the turns 8, the winding mandrel 3 is not clamped either in the conductor 1, 2 between adjacent light-emissive sections 5, 7, so that the winding mandrel 3 can easily be removed.

It is to be noted that it is known from German Patent Specification No. 1,190,566 to wind a filament from tungsten wire on which a molybdenum wire is wound. According to this Patent Specification the molybdenum wire, however, is then removed entirely since said wire serves only to adjust the distance between two adjacent turns of the tungsten wire.

In FIG. 2 a glass lamp envelope 11 has pinched seals 12 at its ends in which respective current supply conductors 13, 13*a* are incorporated which extend towards a filament 14 stretched longitudinally in the lamp envelope 11. The filament 14 has a number of light-emissive sections 15, 16, 17 of helically wound tungsten wire 18. The piece of the tungsten wire 18 between the adjacent light-emissive sections 15 and 16 extends substantially in the longitudinal direction and an iron wire 19 is wound around it. The conductor 20 between the light-emissive sections 16 and 17 is very short so that little energy is dissipated therein. The conductor 20 consists of a piece of the tungsten wire 8 from which the light-emissive sections 15, 16, 17 are wound. Supporting members 21 center the filament 14. The lamp envelope 11 is filled with inert gas.

Reference numeral 31 in FIG. 3 denotes a tubular quartz glass lamp envelope having end seals 32 in which current supply conductors 33, 33*a* are incorporated which extend towards a longitudinally stretched filament 34. In this Figure the filament has a number of identical light-emissive sections 35 and two light-emissive sections 36 all of them consisting of helically wound tungsten wire. Every two adjacent light-emissive sections 35, 36 are connected by a piece of the tungsten wire 38 from which the light-emissive sections 35, 36 are wound, around which piece molybdenum wire 39 is wound. Supporting members 41 of tungsten wire support and maintain the filament 34 centrally in the lamp envelope 31. The lamp envelope is filled with a halogen-containing inert gas.

EXAMPLE

In an embodiment shown in FIG. 3 the light-emissive sections were wound with a pitch of 332 μm from tungsten wire having a diameter of 183 μm. The conductors between every two adjacent light-emissive sections consisted of a piece of the tungsten wire from which said sections had been wound, with a pitch of 75 μm about which molybdenum wire of 50 μm had been wound. The winding mandrel had a diameter of 517 μm.

The lamp envelope was filled with argon to which 0.3% by volume of $CH_2Br_2$ had been added. The filling pressure at room temperature was $2.5\times10^5$ Pa.

During operation at 180 V the lamp consumed a power of 880 W. The overall lamp length was 49.5 mm. The capacity per cm of lamp length was 17.7 W. The filament was manufactured as illustrated with reference to FIG. 1.

What is claimed is:

1. An electric incandescent lamp having a light-transmitting tubular lamp envelope having first and second ends, first and second conductors disposed respectively at said first and second ends, a filament stretched longitudinally in the lamp envelope between said ends, said filament having respective ends electrically connected to said first and second conductors, said envelope being sealed respectively at said first and second ends in a vacuum-tight manner around said first and second conductors, said filament having a plurality of light-emissive axial sections of helically wound tungsten wire, adjacent light-emissive axial sections being connected to each other by an axial section of the same piece of tungsten wire from which said light-emissive axial sections are wound, each of said axial sections of said piece of tungsten wire extending substantially in the longitudinal direction of the lamp envelope, and a wire of a less noble metal than tungsten being wound around said axial sections of the same piece of tungsten wire between adjacent light-emissive axial sections.

* * * * *